US007704302B2

(12) United States Patent
Abdelkrim et al.

(10) Patent No.: US 7,704,302 B2
(45) Date of Patent: Apr. 27, 2010

(54) ELECTROSTATIC PRECIPITATOR HAVING A SPARK CURRENT LIMITING RESISTORS AND METHOD FOR LIMITING SPARKING

(75) Inventors: Younsi Abdelkrim, Ballston Lake, NY (US); Zhou Yingneng, Niskayuna, NY (US); David Johnston, Poquoson, VA (US); Robert W. Taylor, Ponte Vedra Beach, FL (US)

(73) Assignee: General Electric Company, Schenectady, NY (US)

( * ) Notice: Subject to any disclaimer, the term of this patent is extended or adjusted under 35 U.S.C. 154(b) by 400 days.

(21) Appl. No.: 11/679,513

(22) Filed: Feb. 27, 2007

(65) Prior Publication Data

US 2008/0202331 A1 Aug. 28, 2008

(51) Int. Cl.
*B03C 3/66* (2006.01)

(52) U.S. Cl. ..... 96/20; 95/5; 96/82

(58) Field of Classification Search ..... 96/20, 96/21, 80, 82, 95–97; 95/5
See application file for complete search history.

(56) References Cited

U.S. PATENT DOCUMENTS

| | | | | | |
|---|---|---|---|---|---|
| 3,495,379 | A * | 2/1970 | Hall et al. | ..... | 95/79 |
| 3,900,766 | A * | 8/1975 | Kawada | ..... | 361/226 |
| 4,041,768 | A * | 8/1977 | Gibert et al. | ..... | 73/24.03 |
| 4,521,659 | A | 6/1985 | Buckley et al. | | |
| 4,605,424 | A | 8/1986 | Johnston | | |
| 4,665,476 | A * | 5/1987 | Masuda | ..... | 96/25 |
| 4,689,715 | A * | 8/1987 | Halleck | ..... | 361/213 |
| 4,860,149 | A | 8/1989 | Johnston | | |
| 5,024,685 | A * | 6/1991 | Torok et al. | ..... | 96/43 |
| 5,045,095 | A * | 9/1991 | You | ..... | 96/80 |
| 5,061,462 | A * | 10/1991 | Suzuki | ..... | 422/186.04 |
| 5,068,811 | A | 11/1991 | Johnston et al. | | |
| 5,137,552 | A * | 8/1992 | Sasaki | ..... | 96/80 |
| 5,173,867 | A | 12/1992 | Johnston et al. | | |
| 5,515,262 | A | 5/1996 | Johnston et al. | | |
| 5,538,692 | A * | 7/1996 | Joannou | ..... | 422/121 |
| 5,705,923 | A | 1/1998 | Johnston et al. | | |
| 5,733,360 | A * | 3/1998 | Feldman et al. | ..... | 95/78 |
| 5,980,614 | A * | 11/1999 | Loreth et al. | ..... | 96/63 |
| 6,540,812 | B2 | 4/2003 | Farmer et al. | | |
| 6,611,440 | B1 | 8/2003 | Johnston et al. | | |
| 6,628,568 | B1 | 9/2003 | Mahler et al. | | |
| 6,839,251 | B2 | 1/2005 | Johnston et al. | | |
| 7,122,070 | B1 * | 10/2006 | Krichtafovitch | ..... | 95/2 |
| 7,297,182 | B2 * | 11/2007 | Ray et al. | ..... | 95/64 |
| 7,497,893 | B2 * | 3/2009 | Krichtafovitch | ..... | 95/2 |
| 2005/0061152 | A1 * | 3/2005 | Liu | ..... | 96/80 |
| 2008/0078295 | A1 * | 4/2008 | Leng et al. | ..... | 96/77 |

FOREIGN PATENT DOCUMENTS

| | | | | |
|---|---|---|---|---|
| EP | 0379760 A1 * | 8/1990 | ..... | 96/96 |

* cited by examiner

*Primary Examiner*—Richard L Chiesa
(74) *Attorney, Agent, or Firm*—Nixon & Vanderhye P.C.

(57) ABSTRACT

An electrostatic precipitator including: a collecting electrode in a gas passage; a discharge electrode in the gas passage and separated by a gap from the collecting electrode; a power supply applying a voltage to the discharge electrode, wherein the voltage establishes an electric field between the discharge electrode and the collecting electrode to ionize gas flow in the gap, and a resistor in series with the discharge electrode and having an effective resistance in series with the discharge electrode of at least 50 Ohms.

14 Claims, 4 Drawing Sheets

ELECTROSTATIC PRECIPITATOR HAVING A SPARK CURRENT LIMITING RESISTORS AND METHOD FOR LIMITING SPARKING

BACKGROUND OF THE INVENTION

This invention relates to electrostatic precipitators and, particularly, to limiting sparking in electrostatic precipitators.

Electrostatic precipitators use electrical fields to remove particulates from gas streams, such as, boiler flue gas. Precipitators electrically charge particulates to be removed from gases, and tend not to otherwise affect the gases. Electrostatic precipitators typically have low pressure drops, energy requirements and operating costs.

In an electrostatic precipitator for a boiler, an intense electric field is maintained between high-voltage discharge electrodes, typically wires, bars or rigid frames, and grounded collecting electrodes, typically parallel plates arranged vertically. A corona discharge from the discharge electrodes ionizes the flue gas passing between the collecting electrodes. The ionized gas ionizes fly ash and other particles in the flue gas. The electric field between the discharge electrodes and collecting electrodes drives the negatively charged particles to the collecting electrodes. Periodically, the collecting electrodes are rapped mechanically to dislodge the collected particles, which fall into hoppers for removal.

Sparking can occur between the discharge and collecting electrodes. Sparking limits the electrical energization of the electrostatic precipitator. Sparking occurs when the ionized gas in the precipitator has a localized breakdown such that current rises rapidly and voltage drops between one or more electrodes.

Sparking in an electrostatic precipitator can reach tens of thousands of Amperes, while normal operating currents rarely exceed 2 Amps in a precipitator. Sparks between electrodes create a current path that disrupts an otherwise even distribution of current in the electric field between electrodes. Sparking can damage internal the electrodes and other components of an electrostatic precipitator. The fast transients in current and voltage caused by sparking can also damage and fatigue the precipitator and electrical components in and connected to the precipitator. There is a long felt need for devices and methods to reduce the effects of sparking in an electrostatic precipitator.

BRIEF DESCRIPTION OF THE INVENTION

A device and method has been developed to suppress sparking in an electrostatic precipitator A protective resistor is inserted in series with each field or high voltage discharge electrode in an electrostatic precipitator. The resistor preferably has a value in a range of 50 to 1,500 Ohms, or preferably 200 to 500 Ohms. These resistors reduce the peak current during a sparking event in an electrostatic precipitator by factors of 20 to 30. Reducing the peak current mitigates the damage caused by sparking and allows the electrical field to be quickly reestablished after sparking. The individual resistors limit current through the electrode when sparking occurs. The resistors minimize the collapse of the electrical field between electrodes during sparking.

An electrostatic precipitator including: at least one collecting electrode adapted to be in a gas passage; at least one discharge electrode adapted to be in the gas passage and separated by a gap from the at least one collecting electrode; a power supply adapted to apply a voltage to the discharge electrode, wherein the voltage establishes an electric field between the discharge electrode and the collecting electrode to ionize gas flow in the gap, and a resistor in series with the discharge electrode and having an effective resistance in series with the discharge electrode of at least 50 Ohms, wherein the effective resistance may be in a range of 100 to 1000 Ohms, and preferably in a range of 200 to 500 Ohms. The collecting electrodes may be on opposite sides of each discharge electrode and the collecting electrodes are plates in a vertical orientation.

An electrostatic precipitator comprising: at least one collecting electrode in a gas passage, wherein the passage extends along a gas flow path; a first set of a plurality of discharge electrodes arranged in the passage and separated by a gap from the at least one collecting electrode; a first resistor applied in series with the first set of plurality of discharge electrodes, the first resistor has a predetermined value selected such that the voltage applied to the first set of discharge electrodes has a first voltage value; a second set of a plurality of discharge electrodes arranged in the passage and separated by a gap from the at least one collecting electrode, wherein the second set is downstream in the gas flow path from the first set; a second resistor applied in series with the second set of plurality of discharge electrodes, the second resistor has a predetermined value selected such that the voltage applied to the second set of discharge electrodes has a second voltage value lower than the first voltage value, and a power supply adapted to apply a voltage to the first and second sets of discharge electrodes, wherein the voltage establishes an electric field between the discharge electrode of the first set and the collecting electrode to ionize gas flow in the gap.

A method for mitigating sparking in an electrostatic precipitator having at least one discharge electrode, a collecting electrode and at least one resistor in series with the at least one discharge electrode, the method comprising: applying a current to the at least one discharge electrode forming a voltage potential between the discharge electrode and collecting electrode; flowing a gas with particulates through the precipitator and through a gap between the at least one discharge electrode and the collecting electrode; collecting particulates charged by the voltage potential on the collecting electrodes to remove the particulates from the gas; when a spark forms between the discharge electrode and the collecting electrode, reducing current flowing through the electrode by the dissipating current in the at least one resistor.

DETAILED DESCRIPTION OF THE INVENTION

Figure 1:
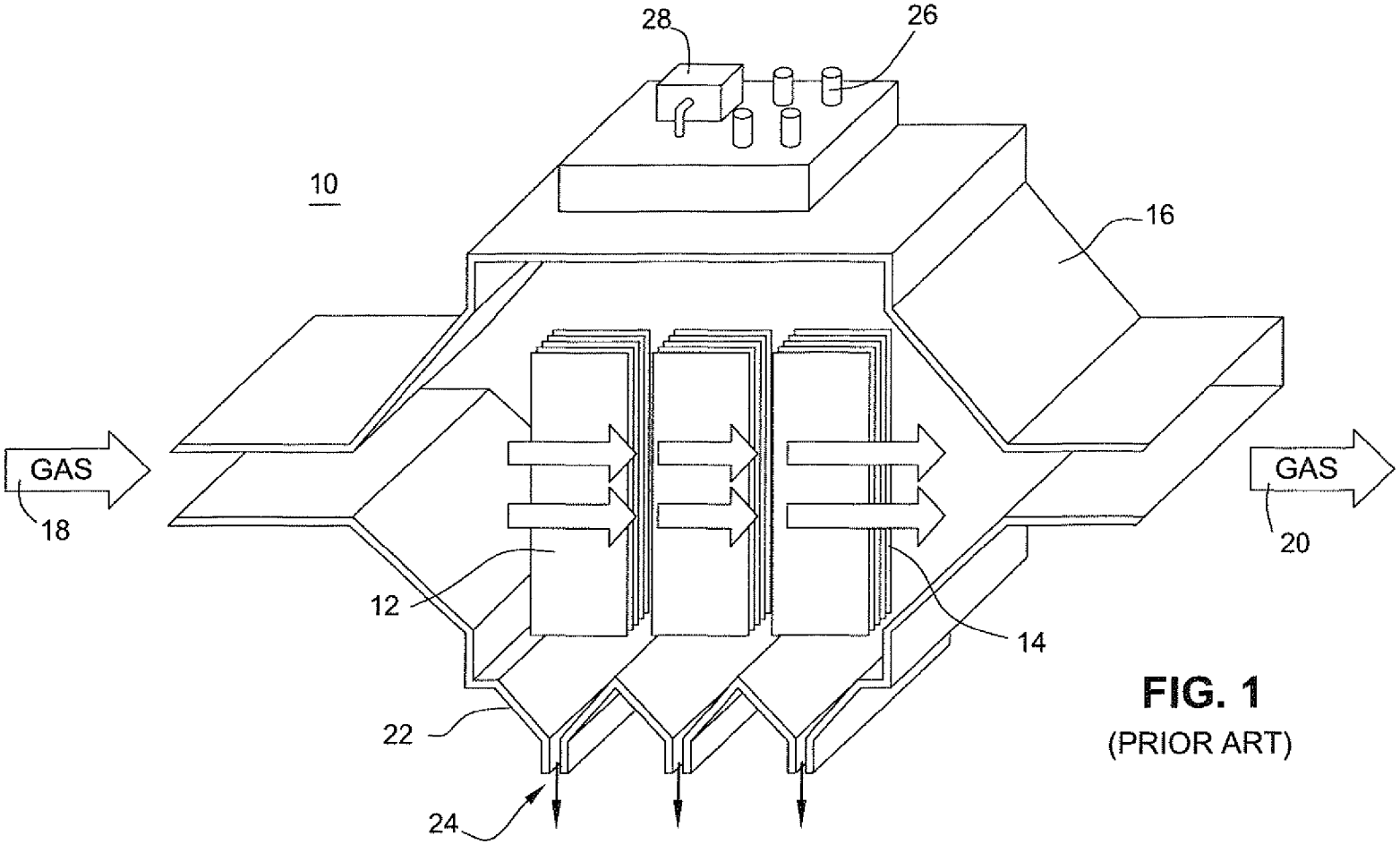
FIG. 1 (PRIOR ART)
FIG. 1 is a perspective view of a conventional electrostatic precipitator.

FIG. 1 is a perspective view of a typical electrostatic precipitator 10. Metal collecting plates 12 are arranged parallel to the gas flow 14 to reduce air resistance to the gas flow. As gases pass over the collecting plates, electrically charge particulates collect on the negatively charged collecting plates surfaces. The plates are normally separated from each other by 9 to 18 inches (23 cm to 46 cm).

The precipitator 10 may have a generally rectangular housing 16 with a side flue gas inlet 18 and an opposite side flue gas outlet 20. The collecting plates 12 are arranged vertically in the interior gas passage in the precipitator. Below the collecting plates are particulate discharge troughs 22 that allow particulates 24 from the collecting plate to fall from the plates and be removed from the precipitator. Rapping devices are adjacent the collecting plates and are moved by rapping actuators 26 arranged on the top of the precipitator. The actuators cause the rapping devices to periodically shake the collecting plates to dislodge particulates from the plates and to drop into the troughs 22. The particulates are discharged through openings 24 at the bottoms of the troughs 22.

High voltage power supplies, e.g., transformers, 28 may be mounted on top of the precipitator and provide electrical current for various sets of the discharge electrodes and collecting plates. These power supplies typically apply direct current (DC) to the discharge electrodes to form an electrical field in the gas path between the discharge electrodes and collecting plates that are typically grounded.

Figure 2:
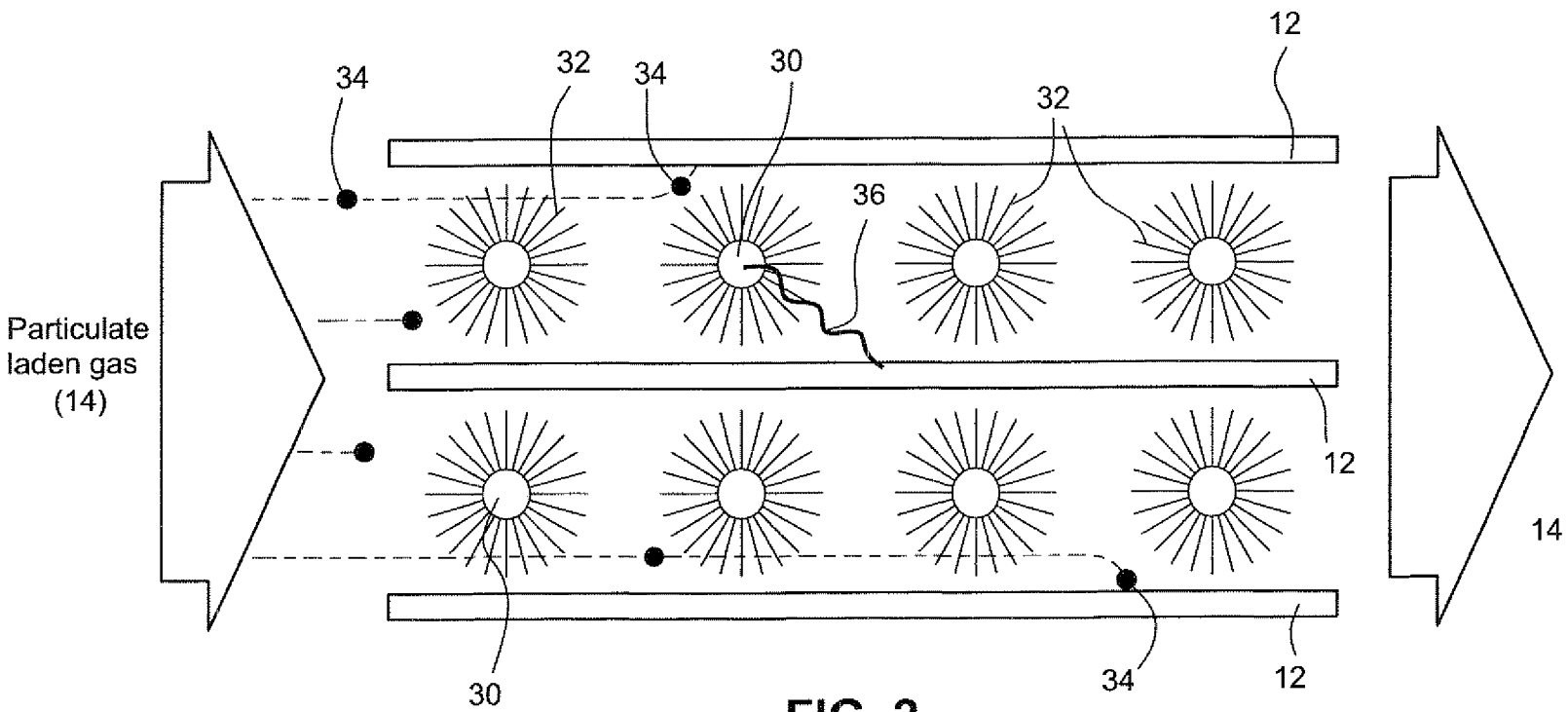
FIG. 2 is a schematic diagram of a gas flow through an electrostatic precipitator having an discharge electrode and collector plates.

FIG. 2 is a schematic diagram showing a top down view of a portion of the interior of the electrostatic precipitator 10 to show the discharge electrodes 30 arranged between the collecting plates 12. An electrical field is formed between the discharge electrodes and collecting plates. The electrical field generates a corona 32 in the gas flow that ionizes the gas flowing through the precipitator. The ionized gas charges particulates 34 in the gas. The charged particulates are attracted to the charged collecting plates 12 on opposite sides of the electrodes. The particles collect on the sides of the collecting plates due to opposite charges on the plates and particles. The particles fall from the collecting plates, e.g., by rapping the plates through the trough 22, and are collected for removal.

The electrostatic precipitator is, in a sense, a capacitor formed by the conductive discharge electrodes 30, the insulating gas flow 14 and the conductive collecting plates 12. An electric field in the gas flow is formed by the voltage difference between the discharge electrodes and collecting plates. The voltage difference represents the charge of a capacitor. A spark 36 between a discharge electrode and a conductive plate causes the capacitor to discharge and the electrical field to breakdown. The spark 36 creates a short burst of high current, e.g., tens of thousands of Amperes, in a circuit that normally operates at about 2 Amps and generally no higher than 5 Amps.

When a spark 36 occurs, the electrical field collapses between the discharge electrode 30 and the conductive plate 12 causing an in-rush of current to ground. The spark can damage the discharge electrode, conductive plate, and the electrical components in the precipitator. After a spark a brief time period is needed to restore the electrical field in the gas flow and resume the associated particulate removal.

A series resistor(s) is included with the discharge electrodes to protect internal precipitator components from sparking, such as by minimizing erosion of these internal components resulting from sparking and arcing. Each electrical field, e.g., a set of discharge electrodes and associated collecting plates, in the precipitator may be powered by a single transformer rectifier or power supply. An automatic voltage control is used to manage application of power to the electrical field. In an electrostatic precipitator, the automatic voltage control drives secondary voltages to the point at which a spark occurs. When a spark occurs, an electrical field will collapse and cause an in-rush of current to ground through the circuit including the discharge electrode and collecting plates. A short period of time is required to restore the electrical field and the associated particulate removal.

A resistor is mounted in series with each discharge electrode and the high voltage support frame, e.g., bus providing power. By virtue of the resistor, the flow of current and associated collapse of the electrical field is confined to the single discharge electrode.

Figure 3:
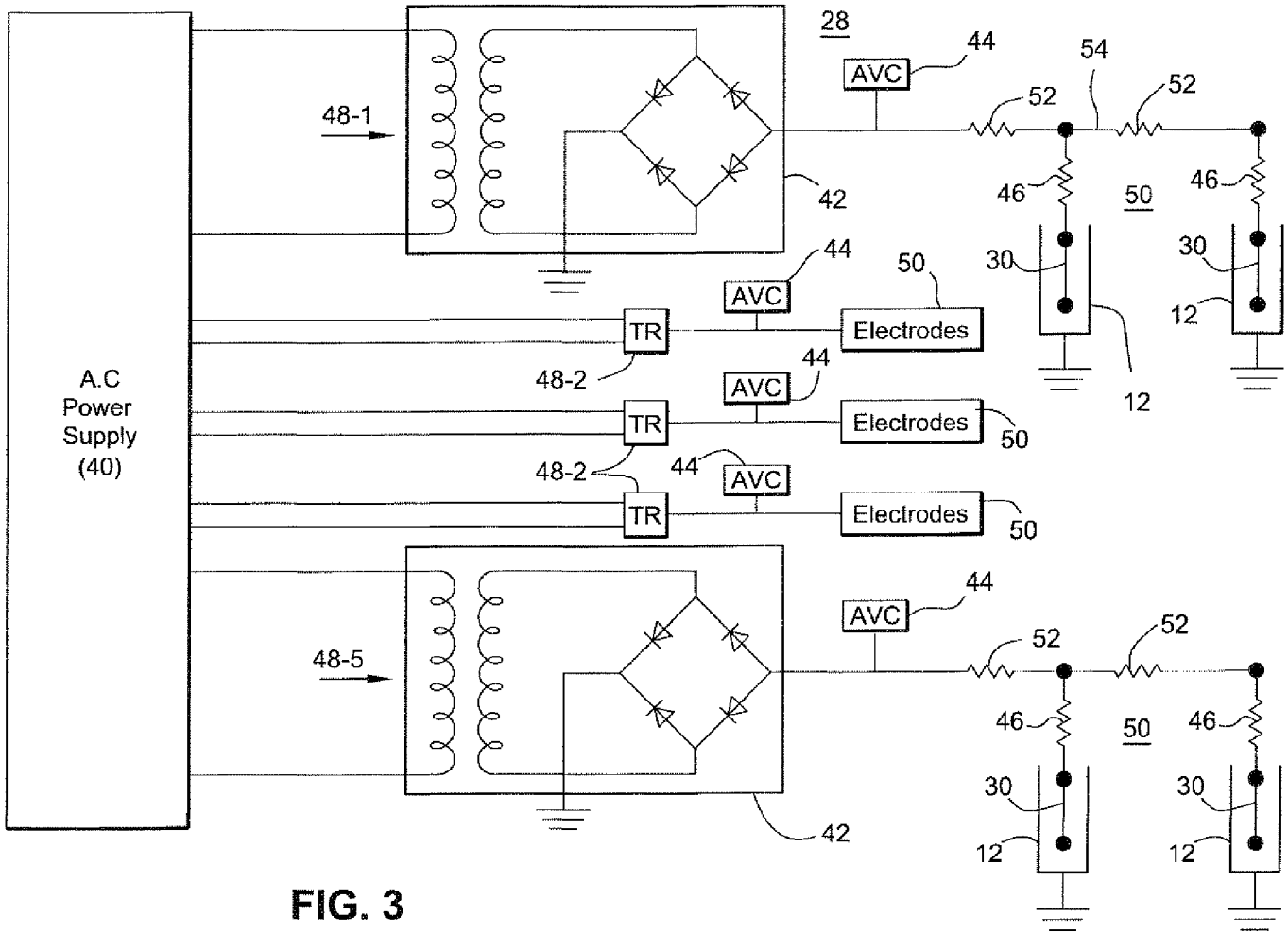
FIG. 3 is a schematic diagram of the electrical components of the electrostatic precipitator.

FIG. 3 is a schematic diagram of the electrical components of the electrostatic precipitator. The power supply (28 in FIG. 1) may be embodied as an electrostatic precipitator may include an alternating current (AC) voltage source 40 of 380 to 600 volts with a frequency of either 50 or 60 Hertz. The power supply is connected to a plurality of transformer-rectifier (TR) units 42, which are secondary power supplies for the discharge electrodes. A full wave, bridge silicon-controlled rectifier in each TR unit 42 converts the alternating current voltage to high voltage, direct current.

The high voltage, direct current output of each TR unit 42 is electrically connected to one or more discharge electrodes 30, e.g., a set of electrodes 50, in the electrostatic precipitator. The direct current applied to the discharge electrodes forms an electrical field across the gap between the discharge electrode and adjacent collecting plates 12. The collecting plates may be grounded to the metal frame of the precipitator housing 16. Each electrical field between a discharge electrode and a collection plate is powered by a corresponding one of the (TR) units 48.

The precipitator has a plurality, e.g., three to five, electrical sections 48 (48-1 to 48-5) each of which may have a TR unit 42 and an associate set 50 of discharge electrodes 30, resistors 46 and sections of the collector plates adjacent the discharge electrodes in the set. The electrical sections 48 are arranged in series with a corresponding TR unit 42. The TR units may be each controlled by an automatic voltage control device (AVC) 44. The automatic voltage control device drives the secondary voltage from the TR unit 48 to the discharge electrodes 30. The automatic voltage control units may regulate the current applied to each set of electrodes 50 up to a level at which a spark occurs.

Alternatively, each electrical section may comprise the discharge electrodes and resistors and not have a separate TR unit and a AVC. In this alternative embodiment, a single TR unit, AVC and power supply provides power for all of the electrical sections and thus all of the discharge electrodes in the precipitator.

A protective resistor 46 is in series with each discharge electrode 30 in the electrostatic precipitator. The resistor has an effective resistance for each discharge electrode preferably in a range of 50 to 1500 Ohms, or more preferably in a range of 100 to 1,000 Ohms or even in a narrower range of 200 to 500 Ohms. The resistor may be formed of a metallic or ceramic material, and can withstand high wattage, e.g., up to 450 watts. The protective resistors 46 may reduce the peak current applied to their respective discharge electrode during a sparking event a factor of 20 to 30. The protective resistors also reduce the current through the TR units during a sparking event. The resistors also minimize peak current through adjacent electrodes in the set 50. Accordingly, the resistors 46 minimize the collapse of the electrical field between electrodes during sparking. By mounting each discharge electrode 30 to a resistor 46 in series with the high voltage support frame (ground), the flow of current and associated collapse of the electrical field due to sparking is generally confined to the single discharge electrode.

The discharge electrodes may be arranged in sets within the gas path through the precipitator. Each set is positioned in the precipitator such that the discharge electrodes in the set have a generally uniform dust load. Each set of electrodes has an associated resistor(s) that may be applied to all or a subset of the electrodes. The resistors mitigate sparking and may be sized to apply an optimal voltage to each electrode. Alternatively, each set may have a separate TR unit and AVC which applying an optimal voltage to each electrode, and the resistor is sized solely to mitigate sparking. A common power supply for all sets of electrodes in the precipitator supplies a uniform voltage to each set. The voltage applied to each set of discharge electrode is dependent on the value of the associated resistor(s) in each set. By selecting an appropriate resistor value, the voltage applied to each set of electrodes is tailored to account for the dust burden on all discharge electrodes in the set. The dust burden is the amount of dust accumulating on the collector plates and is highest the leading surfaces of the collecting plates. Accordingly, the voltage applied to each set of discharge electrodes may be tailored for the set by a relatively inexpensive approach of selecting resistor values and without having separate power supplies for each set, which would be a more expensive approach.

Resistance may also is added to the electrical field to compensate for asymmetrical sparking conditions. Where two or more electrical discharge electrodes are energized by a common transformer rectifier (TR) 48 or other power supply, a resistor 52 is installed in an electrical bus 54 used to energize the field. Sparking occurring in one discharge electrode(s) 30 would not completely discharge the other electrodes in the same set 50. The resulting improvement in performance could be achieved at a cost significantly lower than installing a new transformer rectifier, current limiting reactor, high voltage bus and guard, control cabinet, voltage control, and key interlock.

Each independent electrical section 48 includes a set of electrodes 50 to remove a fraction of the particulate in the gas stream. Each electrode set 50 includes discharge electrodes in a selected region, e.g., near the leading edges of the collecting plates, of the precipitator. The precipitator may be divided (for purposes of the electrodes) into fields wherein in each field is a region in the precipitator that receives substantially the same amount of dust from the gas passing through the precipitator. The collection of all electrode sets 50 forms a complete array of discharge electrodes in the precipitator.

A uniform voltage level is applied to the discharge electrodes in each set. The voltage arrangement of independent sections 48 allows the application of different voltages to the different sets 50 of electrodes. For example, higher voltages may be used in the first section 48-1, which has a set 50 of discharge electrodes 30 located near the leading edges of the collector plates where there is more particulate to be removed. The lowest voltages may be used in the section 48-5 which has a set 50 of discharge electrodes 30 near the trailing edges of the collector plates where the dust build-up, e.g. dust burden, tends to be least. Higher dust levels typically correspond to higher sparking rates that are higher than the sparking rates experienced with electrodes having low dust levels.

The voltage applied to each set 50 of discharge electrodes may be determined by selection of the resistors 52 and/or 46 in series with the discharge electrodes. By properly selecting the series resistors, the voltage applied to the discharge electrodes 30 can be optimized for the dust burden on the set of electrodes 50. A series resistor(s) 52 in each set 50 may be used for optimizing the voltage applied to the discharge electrodes in the set and a second series electrode 46 may be applied for spark mitigation, although the first resistor 52 will assist in spark mitigation. Alternatively, the voltage applied to each set 50 of electrode may be regulated by a TR unit and AVC for each set, as is shown in FIG. 3.

The dust burden is generally greatest at the leading edges of the collecting plates in the precipitators. The leading edges of the collecting plates 12 are the sections of the collector plates facing the gas flow through the precipitator. Dust builds up on the leading edge and sections of the collector plates that are near the leading edge. The dust burden gradually diminishes in a gas flow downstream direction through the precipitator. There tends to be less dust build up on the trailing edges of the collecting plates and the sections of the plates towards the downstream sections of the precipitator.

The sets 50 of discharge electrodes 30 are each arranged and powered commensurate to the dust burden in the region of the precipitator in which the set is positioned. The dust burden refers to the level of particulate in the gas flow at the corresponding discharge electrode. For example, the set 50 of discharge electrodes 30 for the electrical section 48-1 may be arranged near the inlet, e.g., at the leading edges of the collection plates, where the dust burden is highest. Each subsequent electrical section 48-2, 48-3, 48-4 and 48-5 has a set 50 of discharge electrodes arranged sequentially downstream in the gas path through the precipitator. The arrangement of each set in the precipitator is such that the discharge electrodes in the set receive the same dust burden. For example, the set 50 of discharge electrodes 30 for electrical section 48-2 may be arranged transverse to the gas stream and downstream from the electrical section 48-2 and upstream of the set 50 of electrodes for section 48-3. Similarly, the set 50 of electrodes for section 48-3 is upstream of the set 50 for section 48-4, and the discharge electrode set 50 for section 48-5 may be near the trailing edges of the collecting plates 12.

Spark rates in a precipitator tend to be highest where the dust burden is greatest. The spark rate is depended on the dust burden and the DC voltage level applied to a discharge electrode. If the DC voltage level is the same for all discharge electrodes in an entire precipitator, the spark rate tends to be higher in the front half of a precipitator where the dust burden is higher than in the back half of the precipitator. Arranging the discharge electrodes is sets 50 in which all electrodes in a set have the same dust burden allows the voltage level for the set to be optimal for the dust burden on all electrodes.

The electrical sections 48, each with a set 50 of discharge electrodes, divide the precipitator into a plurality of electrical fields. Each field is generally transverse to the gas flow because each electrode set 50 is transverse to the gas flow so that the discharge electrodes 30 in each set is arranged at about the same position relative to the direction of the gas flow. For example, all of the discharge electrodes in a set may be arranged along a line transverse to the gas flow or within a range of one foot to 10 feet with respect to the direction of the gas flow.

The discharge electrodes 30 in each set experience about the same dust burden. Sparking rates are dependent on the dust burden and direct current voltage level. By arranging the discharge electrodes in each set 50 to have a common dust burden, the voltage applied to the electrodes can be set by the automatic voltage control (AVC) so that all of the electrodes 30 in the set have an optimal voltage level. The AVC 44 for each electrical section 48 optimizes the direct current voltage to the discharge electrodes 30 in the corresponding set 50. The optimal voltage level may be that which the AVC determines increases the electrical field strength while holding the sparking rate to acceptably low levels.

Alternatively, the precipitator may have a single AVC and TR unit that apply a uniform power to all discharge electrodes. The voltage applied to the discharge electrode in each set is dependent on the resistors 52, 46 in series with the discharge electrode. For example, one or more resistors 52 may be in each set 50 of electrodes and the value of these resistors determines the voltage applied to each discharge electrode. A lower resistance level may be selected for the resistor(s) 52 in the forward in the precipitator set 50 to achieve higher voltages on the discharge electrodes in that set. The highest level resistor(s) 52 may be selected for the rear set 50 to lower the voltage on the discharge electrodes 30 at the rear of the precipitator. By way of example, the resistors in each set may decrease in value by 50 to 200 Ohms from set to adjacent set.

Segmenting the electrical field into independent sections 48 arranged transverse to the gas flow should increase collection efficiency. The independent sections can each apply a voltage level which is appropriate for the electrodes 30 in the field corresponding to the section. The voltage level applied to the discharge electrodes 30 in each section 48 may be selected to correspond to the maximum voltage level for all discharge electrodes in the section, e.g., set 50. The discharge electrodes in a set have a common maximum voltage level because all of the electrodes in the set have the same dust burden and sparking rate.

Any one discharge electrode in a set 50 should not have a sparking rate or a dust burden that is substantially greater than the other discharge electrodes in the set. Because all discharge electrodes in the precipitator are operating at or near their maximum DC voltage, the average applied secondary voltage will increase as a result of splitting the original field into two independently energized fields.

Further, gradient conditions exist across the electrostatic precipitator. These gradients can be nonuniform temperature resulting from regenerative air heater rotation, non uniform dust burden, and uneven distribution of gas in the precipitation. These gradient conditions can result in the spark rate observed at one side of a high voltage frame of a precipitator to be higher than the opposite side of the frame. Segmenting the discharge electrodes in the precipitator allows the voltages applied to each set of precipitators to be selected to account for gradient conditions. Further, use of multiple resistors 52, 46 further allows the voltage applied to individual discharge electrodes to be tailored to account for gradient conditions and other conditions, e.g., dust burden.

Figure 4:
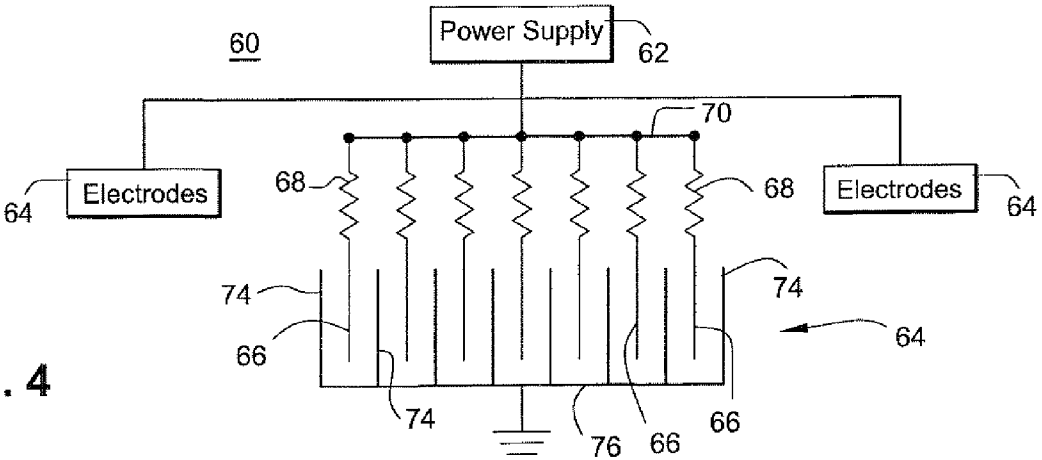
FIG. 4 is an alternative electrical circuit for the electrostatic precipitator.

FIG. 4 shows an alternative electrical circuit arrangement 60 for an electrostatic precipitator. A single power supply unit 62 having a TR unit and an AVC provides power to all discharge electrodes in the precipitator. The discharge electrodes may be arranged in one or more sets 64. Each set 64 includes an array of discharge electrodes 66 each in series with a resistor 68 coupled to an electrical bus 70 in the set that in turn connects to an electrical bus 72 for the precipitator power supply 62. The discharge electrodes are interleaved with collecting plates 74 that are arranged on opposite sides of each discharge electrode. The collecting plates are connected to a bus 76 that is grounded.

The resistors 68 are selected to mitigate the effects of sparking between the discharge electrodes and the collecting plates. The value of the resistor may be in the range of 50 to 1,500 Ohms, preferably in a range of 100 to 1,000 Ohms or more preferably in a range of 200 to 500 Ohms. In addition, the value of the resistors 68 may be selected to tailor the voltage level applied to the discharge electrodes to account for the dust burden and other environmental factors influencing sparking. For example, all resistors 68 in each set 64 may have a common resistance value. The value of the resistors 68 in the set near the inlet to the precipitator may be high, and the value of resistors 68 in each set is progressively decreasing from set to set such that the resistors 68 in the rear set 64 is the lowest. Further, the resistors 68 may be applied to a subset of the discharge electrodes most susceptible to sparking, such as the electrodes near the leading edge of the set. Discharge electrodes in the set downstream of the leading edge may not need resistors 68 because they are less susceptible to sparking.

Figure 5:
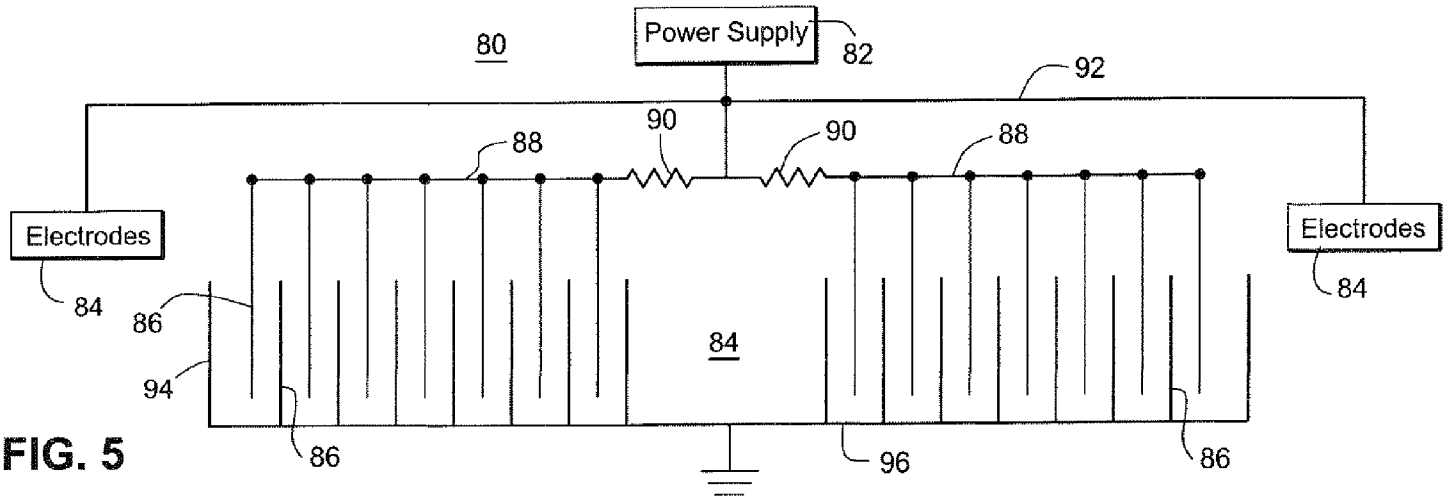
FIG. 5 is a further alternative electrical circuit for the electrostatic precipitator.

FIG. 5 is another electrical circuit arrangement 80 for an electrostatic precipitator. A single power supply unit 82 having a TR unit and an AVC provides power to all discharge electrodes in the precipitator. The discharge electrodes may be arranged in one or more sets 84. Each set 84 includes an array of discharge electrodes 86 coupled to an electrical bus 88 which includes a series resistor 90. The bus 88 connects to an electrical bus 92 for the precipitator power supply 82. The discharge electrodes are interleaved with collecting plates 94 that are arranged on opposite sides of each discharge electrode. The collecting plates are connected to an electrical bus 96 that is grounded.

The resistors 90 have a resistance value to mitigate sparking. Because the resistors 90 are in series with multiple discharge electrodes the value of the resistor is selected such that the series resistance seen by each discharge electrode is appropriate to mitigate sparking. For example, an effective series resistance seen by each discharge electrode is in a range of 50 to 1,500 Ohms, preferably in a range of 100 to 1,000 Ohms or more preferably in a range of 200 to 500 Ohms. Further, the resistors 90 in each set 84 may have a resistive value such that the voltage applied to the discharge electrodes in each set is tailored for the position of the set in the precipitator. For example, the set 84 near the inlet to the precipitator may have resistors 90 having a relatively high resistive value, and the resistors 94 in the other sets may have progressively decreasing resistive values from the front to the rear of the precipitator. By way of example, the resistors in each set may decrease in value by 50 to 200 Ohms from set to adjacent set.

Using the above-described arrangement, the electrical fields of a precipitator are divided into smaller independently energized sections. The division may be in the direction of gas flow and/or perpendicular to gas flow. The division of sections 50 of discharge electrodes minimizes the impact of sparking located in a specific region of an electrical field.

For example, the dust burden is heaviest at the leading edge. Dust is removed throughout the field resulting in the dust burden being the lowest at the trailing edge of the field. Splitting this electrical field into two independently energized fields in the direction of gas flow increases dust collection efficiency. The spark rate defined by the dust burden will be higher in the new electrical field comprised of the front half of the original field compared to the spark rate observed in the second half of the original field. The average applied secondary voltage will increase as a result of splitting the original field into two independently energized fields.

Similarly, gradients exist across the face of an electrostatic precipitator. These gradients can be non uniform temperature resulting from regenerative air heater rotation, non uniform dust burden, and mal distribution of gas. These conditions can result in the spark rate observed at one edge of the high voltage frame to be higher than the opposite end of the frame. The highest spark rate location will limit average voltage applied to the field.

Splitting the high voltage frame perpendicular to flow into two independently energized electrical fields will improve electrostatic precipitator performance. FIG. 3 shows a circuit in which sets of discharge electrodes are divided into independently energized electrical fields, where each field corresponds to a set 50 of electrodes.

A similar benefit to independent energization of electrical fields is derived by adding resistance to the electrical field to offset asymmetrical sparking conditions, as shown in FIGS. 4 and 5. Where two electrical sections are energized by a common transformer rectifier or power supply, a resistor could be installed in both sections of electrical bus used to energize the field. Sparking occurring in one section would not completely discharge the other frame. The resulting improvement in performance could be achieved at a cost significantly lower than installing a new transformer rectifier, current limiting reactor, high voltage bus and guard, control cabinet, voltage control, and key interlock.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An electrostatic precipitator comprising:

a first collecting electrode and a second collecting electrode both in a gas passage, wherein the second collecting electrode is downstream in a gas flow direction from the first collecting electrode;

a first discharge electrode in the gas passage and separated by a first gap from the first collecting electrode, and a second discharge electrode in the gas passage and separated by a second gap from the second collecting electrode;

a power supply applying a voltage to the first discharge electrode and second discharge electrode, wherein the voltage establishes an electric field between the first discharge electrode and the first collecting electrode to ionize gas flow in the first gap and between the second discharge electrode and the second collecting electrode to ionize gas flow in the second gap, and a first resistor in series with the first discharge electrode and having first effective resistance in series with the first discharge electrode of at least 50 Ohms, and a second resistor in series with the second discharge electrode and having a second effective resistance in series with the second discharge electrode, wherein the second effective resistance is greater than the first effective resistance.

2. An electrostatic precipitator as in claim 1 wherein the first resistor and the second resistor are each formed of at least one of a metal and ceramic material.

3. An electrostatic precipitator comprising:

at least one collecting electrode in a gas passage;

at least one discharge electrode in the gas passage and separated by a gap from the at least one collecting electrode;

a power supply applying a voltage to the discharge electrode, wherein the voltage establishes an electric field between the discharge electrode and the collecting electrode to ionize gas flow in the gap, and a resistor in series with the discharge electrode and having an effective resistance is in a range of 100 to 1000 Ohms.

4. An electrostatic precipitator as in claim 3 wherein the effective resistance is in a range of 200 to 500 Ohms.

5. An electrostatic precipitator as in claim 3 wherein the at least one collecting electrode includes a pair of collecting electrode plates on opposite sides of each discharge electrode and the plates are in a vertical orientation in the passage.

6. An electrostatic precipitator as in claim 3 wherein the at least one discharge electrode is a plurality of discharge electrodes and the resistor is in series with the plurality of discharge electrodes.

7. An electrostatic precipitator as in claim 3 wherein the at least one discharge electrode is a plurality of discharge electrodes and the resistor is in series with a subset of the plurality of discharge electrodes.

8. An electrostatic precipitator as in claim 3 wherein the resistor is a plurality of resistors and a first resistor of said resistors is in series with a first discharge electrode, and a second resistor of said resistors is in series with a second discharge electrode, wherein a resistance value of the first resistor is substantially different from a resistance value of the second resistor.

9. An electrostatic precipitator as in claim 8 wherein the first discharge electrode is upstream of the second discharge electrode in the gas passage, and the first resistor has a higher resistance value than a resistance value of the second resistor.

10. An electrostatic precipitator comprising:

a first set of discharge electrodes arranged in the passage and separated by a gap from a first set of collecting electrodes;

a first resistor applied in series with the first set of discharge electrodes, the first resistor having a predetermined value such that the voltage applied to the first set of discharge electrodes has a first voltage value;

a second set of a plurality of discharge electrodes arranged in the passage and separated by a gap from a second set of collecting electrodes, wherein the second set of discharge electrodes is downstream in the gas flow path from the first set of discharge electrodes;

a second resistor applied in series with the second set of discharge electrodes, the second resistor has a predetermined value such that the voltage applied to the second set of discharge electrodes has a second voltage value lower than the first voltage value, and a power supply applying a voltage to the first and second sets of discharge electrodes, wherein the voltage establishes an electric field between the discharge electrodes and the collecting electrodes to ionize gas flow in the gap.

11. An electrostatic precipitator as in claim 10 wherein the first resistor has effective series resistance for each discharge electrode in the first set of discharge electrodes in a range of 50 to 1500 Ohms.

12. An electrostatic precipitator as in claim 10 wherein the first resistor has effective series resistance for each discharge electrode in the first set of discharge electrodes in a range of 100 to 1000 Ohms.

13. An electrostatic precipitator as in claim 10 wherein the first resistor has effective series resistance for each discharge electrode in the first set of discharge electrodes in a range of 200 to 500 Ohms.

14. An electrostatic precipitator as in claim 10 wherein each collecting electrode includes a pair of collecting plates on opposite sides of each of the discharge electrodes.

* * * * *